US008036894B2

(12) United States Patent
Neeracher et al.

(10) Patent No.: US 8,036,894 B2
(45) Date of Patent: Oct. 11, 2011

(54) MULTI-UNIT APPROACH TO TEXT-TO-SPEECH SYNTHESIS

(75) Inventors: Matthias Neeracher, Santa Clara, CA (US); Devang K. Naik, San Jose, CA (US); Kevin B. Aitken, Cupertino, CA (US); Jerome R. Bellegarda, Los Gatos, CA (US); Kim E.A. Silverman, Mountain View, CA (US)

(73) Assignee: Apple Inc., Cupertino, CA (US)

( * ) Notice: Subject to any disclaimer, the term of this patent is extended or adjusted under 35 U.S.C. 154(b) by 937 days.

(21) Appl. No.: 11/357,736

(22) Filed: Feb. 16, 2006

(65) Prior Publication Data

US 2007/0192105 A1 Aug. 16, 2007

(51) Int. Cl.
*G10L 13/06* (2006.01)

(52) U.S. Cl. ..... 704/267; 704/258; 704/260; 704/268

(58) Field of Classification Search ..... 704/10, 704/243, 258, 260, 266, 267
See application file for complete search history.

(56) References Cited

U.S. PATENT DOCUMENTS

| | | | | |
|---|---|---|---|---|
| 4,278,838 | A | 7/1981 | Antonov | |
| 5,732,395 | A | 3/1998 | Silverman | |
| 5,771,276 | A * | 6/1998 | Wolf | 379/88.16 |
| 5,850,629 | A | 12/1998 | Holm et al. | |
| 6,014,428 | A * | 1/2000 | Wolf | 379/88.11 |
| 6,047,255 | A * | 4/2000 | Williamson | 704/212 |
| 6,125,346 | A * | 9/2000 | Nishimura et al. | 704/258 |
| 6,173,263 | B1 | 1/2001 | Conkie | |
| 6,185,533 | B1 * | 2/2001 | Holm et al. | 704/267 |
| 6,513,008 | B2 * | 1/2003 | Pearson et al. | 704/260 |
| 6,535,852 | B2 | 3/2003 | Eide | |
| 6,757,653 | B2 * | 6/2004 | Buth et al. | 704/258 |
| 6,862,568 | B2 * | 3/2005 | Case | 704/260 |
| 6,910,007 | B2 | 6/2005 | Stylianou et al. | |
| 6,978,239 | B2 * | 12/2005 | Chu et al. | 704/258 |
| 6,990,450 | B2 * | 1/2006 | Case et al. | 704/260 |
| 7,035,794 | B2 * | 4/2006 | Sirivara | 704/219 |
| 7,191,131 | B1 * | 3/2007 | Nagao | 704/258 |
| 7,292,979 | B2 * | 11/2007 | Karas et al. | 704/244 |
| 7,472,065 | B2 | 12/2008 | Aaron et al. | |
| 2002/0052730 | A1 * | 5/2002 | Nakao | 704/10 |
| 2002/0072908 | A1 * | 6/2002 | Case et al. | 704/260 |
| 2002/0133348 | A1 * | 9/2002 | Pearson et al. | 704/258 |
| 2002/0173961 | A1 * | 11/2002 | Guerra | 704/258 |
| 2003/0050781 | A1 * | 3/2003 | Tamura et al. | 704/267 |

(Continued)

OTHER PUBLICATIONS

Chung-Hsien Wu, Jau-Hung Chen, Automatic generation of synthesis units and prosodic information for Chinese concatenative synthesis, Speech Communication, vol. 35, Issues 3-4, Oct. 2001, pp. 219-237, ISSN 0167-6393.*

*Primary Examiner* — Richemond Dorvil
*Assistant Examiner* — Douglas C Godbold
(74) *Attorney, Agent, or Firm* — Fish & Richardson P.C.

(57) ABSTRACT

Methods, apparatus, systems, and computer program products are provided for synthesizing speech. One method includes matching a first level of units of a received input string to audio segments from a plurality of audio segments including using properties of or between first level units to locate matching audio segments from a plurality of selections, parsing unmatched first level units into second level units, matching the second level units to audio segments using properties of or between the units to locate matching audio segments from a plurality of selections and synthesizing the input string, including combining the audio segments associated with the first and second units.

33 Claims, 9 Drawing Sheets

U.S. PATENT DOCUMENTS

2004/0111266 A1* 6/2004 Coorman et al. ..... 704/260
2004/0254792 A1* 12/2004 Busayapongchai et al. .. 704/260
2005/0119890 A1* 6/2005 Hirose ..... 704/260
2006/0074674 A1* 4/2006 Zhang et al. ..... 704/260
2007/0106513 A1* 5/2007 Boillot et al. ..... 704/260
2007/0244702 A1* 10/2007 Kahn et al. ..... 704/260
2008/0071529 A1 3/2008 Silverman et al.
2009/0076819 A1* 3/2009 Wouters et al. ..... 704/260

* cited by examiner

MULTI-UNIT APPROACH TO TEXT-TO-SPEECH SYNTHESIS

BACKGROUND

The following disclosure generally relates to information systems.

In general, conventional text-to-speech application programs produce audible speech from written text. The text can be displayed, for example, in an application program executing on a personal computer or other device. For example, a blind or sight-impaired user of a personal computer can have text from a web page read aloud from the personal computer. Other text to speech applications are possible including those that read from a textual database and provide corresponding audio to a user by way of a communication device, such as a telephone, cellular telephone or the like.

Speech from conventional text-to-speech applications typically sounds artificial or machine-like when compared to human speech. One reason for this result is that current text-to-speech applications often employ synthesis, digitally creating phonemes to be spoken from mathematical principles to mimic a human enunciation of the same. Another reason for the distinct sound of computer speech is that phonemes, even when generated from a human voice sample, are typically stitched together with insufficient context. Each voice sample is typically independent of adjacently played voice samples and can have an independent duration, pitch, tone and/or emphasis. When different words are formed that rely on the same phoneme as represented by text, conventional text-to-speech applications typically output the same phoneme represented as a voice sample. However, the resulting speech formed from the independent samples often sounds less than desirable.

SUMMARY

This disclosure generally describes systems, methods, computer program products, and means for synthesizing text into speech. A proposed system can provide more natural sounding (i.e., human sounding) speech. The proposed system can form speech from phonetic segments or a combination of higher level sound representations that are enunciated in context with surrounding text. The proposed system can be distributed, in that the input, output and processing of the various streams or data can be performed in several or one location. The input and capture, processing and storage of samples can be separate from the processing of a textual entry. Further, the textual processing can be distributed, where for example the text that is identified or received can be at a device that is separate from the processing device that performs the text to speech processing. Further, the output device that provides the audio can be separate or integrated with the textual processing device. For example, a client server architecture can be provided where the client provides or identifies the textual input, and the server provides the textual processing, returning a processed signal to the client device. The client device can in turn take the processed signal and provide an audio output. Other configurations are possible.

The resulting speech takes into account prosody characteristics including the tune and rhythm of the speech. Moreover, the proposed system can be trained with a human voice so that the resulting speech is even more convincing.

In one aspect, a method is provided that includes matching first units of a received input string to audio segments from a plurality of audio segments including using properties of or between the first units, such as adjacency, to locate matching audio segments from a plurality of selections, parsing unmatched first units into second units, matching the second units to audio segments using properties of or between the second units to locate matching audio segments from a plurality of selections and synthesizing the input string, including combining the audio segments associated with the first and second units.

Aspects of the invention can include one or more of the following features. Properties can include those associated with unit and concatenation costs. Unit costs can include considerations of one or more of pitch, duration, accentuation, and spectral characteristics. Unit costs measure the similarity or difference from an ideal model. Predictive models can be used to create ideal pitch, duration etc. predictors that can be used to evaluate which unit from a group of similar units (i.e., similar text unit but different audio sample) should be selected. Concatenation costs can include those associated with articulation relationships such as adjacency between units in samples. Concatenation costs measure how well a unit fits with a neighbor unit. Matching the first and second units can include searching metadata associated with the plurality of audio segments and that describes properties of or between the plurality of audio segments. The method can further include parsing unmatched second units into third units having properties of or between the units, matching the third units to audio segments including, searching metadata associated with the plurality of audio segments and that describes the properties of the plurality of audio segments.

The method can further include providing an index to the plurality of audio segments and generating metadata associated with the plurality of audio segments. Generating the metadata can include receiving a voice sample, determining two or more portions of the voice sample having shared properties and generating a portion of the metadata associated with a first portion of the voice sample to associate a second portion of the voice sample, and a portion of the metadata associated with the second portion of the voice sample to associate the first portion of the voice sample.

The first units can each comprise one or more of one or more sentences, one or more phrases, one or more word pairs, or one or more words. The input string can be received from an application or an operating system. The method can further include transforming unmatched portions of the input string to uncorrelated phonemes or other sub-word units. The input string can comprise ASCII or Unicode characters. The method can further include outputting amplified speech comprising the combined audio segments.

Aspects of the invention can include one or more of the following features. Synthesizing can include synthesizing both matching audio segments for successfully matched portions of the input stream and uncorrelated phonemes or other sub-word units for unmatched portions of the input stream.

In another aspect, a computer program product including instructions tangibly stored on a computer-readable medium is provided. The product includes instructions for causing a computing device to match first units of an input string that have desired properties to audio segments from a plurality of audio segments, parse unmatched first units into second units having desired properties, match the second units to audio segments and synthesize the input string, including combining the audio segments associated with the first and second units.

In another aspect, a system is provided that includes an input capture routine to receive an input string that includes first units having properties, a unit matching engine, in communication with the input capture routine, to match the first units to audio segments from a plurality of audio segments, a parsing engine, in communication with the unit matching engine, to parse unmatched first units into second units having properties, the unit matching engine configured to match the second units to audio segments, a synthesis block, in communication with the unit matching engine, to synthesize the input string, including combining the audio segments associated with the first and second units and a storage unit to store audio segments and properties.

In another aspect a method is provided that includes providing a library of audio segments and associated metadata defining properties of or between a given segment and another segment, the library including one or more levels of units in accordance with a hierarchy, and matching, at a first level of the hierarchy, units of a received input string to audio segments, the received input string having one or more units at a first level having defined properties. The method includes parsing unmatched units to units at a second level in the hierarchy, matching one or more units at the second level of the hierarchy to audio segments having defined properties and synthesizing the input string including combining the audio segments associated with the first and second levels.

DETAILED DESCRIPTION

Systems, methods, computer program products, and means for text-to-speech synthesis are described. An input stream of text can be mapped to audio segments that take into account properties of and relationships (including articulation relationships) among units from the text stream. Articulation relationships refer to dependencies between sounds when spoken by a human. The dependencies can be caused by physical limitations of humans (e.g., limitations of lip movement, vocal cords, air intake or outtake, etc.) when, for example, speaking without adequate pause, speaking at a fast rate, slurring, and the like. Properties can include those related to pitch, duration, accentuation, spectral characteristics and the like. Properties of a given unit can be used to identify follow on units that are a best match for combination in producing synthesized speech. Hereinafter, properties and relationships that are used to determine units that can be selected from to produce the synthesized speech are referred to in the collective as merely properties.

Figure 1:
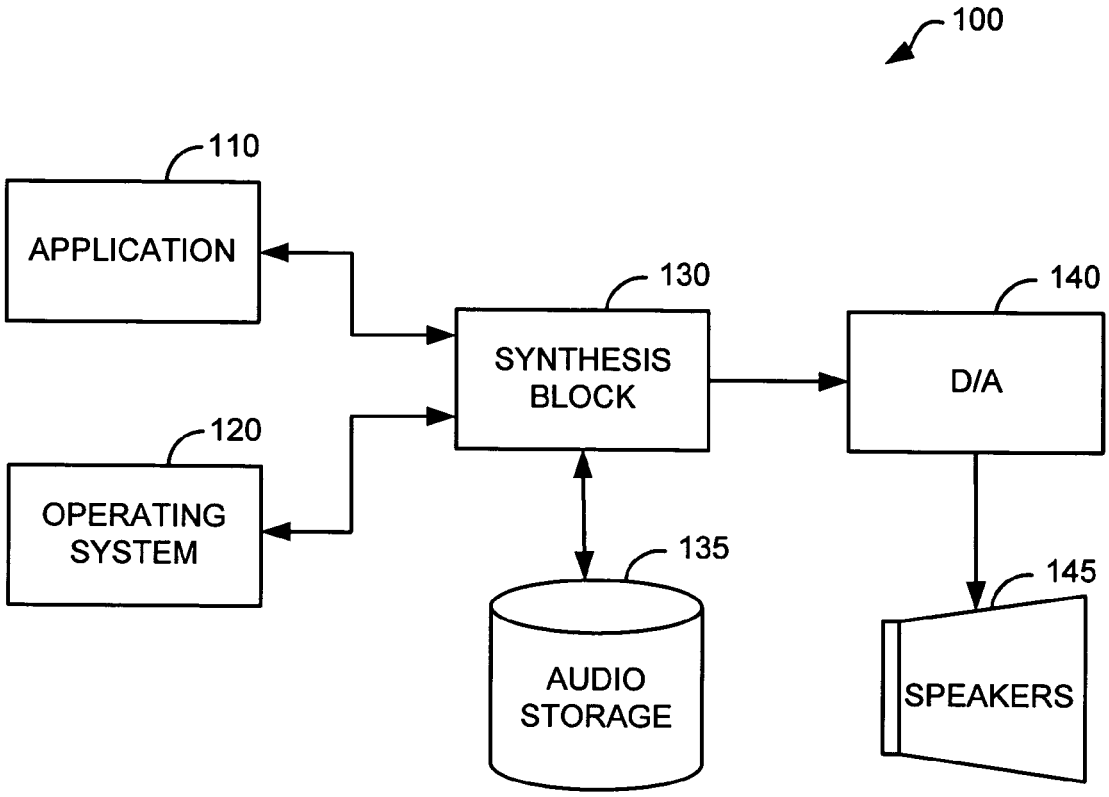
FIG. 1 is a block diagram illustrating a proposed system for text-to-speech synthesis.

FIG. 1 is a block diagram illustrating a system 100 for text-to-speech synthesis. System 100 includes one or more applications such as application 110, an operating system 120, a synthesis block 130, an audio storage 135, a digital to analog converter (D/A) 140, and one or more speakers 145. The system 100 is merely exemplary. The proposed system can be distributed, in that the input, output and processing of the various streams and data can be performed in several or one location. The input and capture, processing and storage of samples can be separate from the processing of a textual entry. Further, the textual processing can be distributed, where for example the text that is identified or received can be at a device that is separate from the processing device that performs the text to speech processing. Further, the output device that provides the audio can be separate or integrated with the textual processing device. For example, a client server architecture can be provided where the client provides or identifies the textual input, and the server provides the textual processing, returning a processed signal to the client device. The client device can in turn take the processed signal and provide an audio output. Other configurations are possible.

Returning to the exemplary system, application 110 can output a stream of text, having individual text strings, to synthesis block 130 either directly or indirectly through operating system 120. Application 110 can be, for example, a software program such as a word processing application, an Internet browser, a spreadsheet application, a video game, a messaging application (e.g., an e-mail application, an SMS application, an instant messenger, etc.), a multimedia application (e.g., MP3 software), a cellular telephone application, and the like. In one implementation, application 110 displays text strings from various sources (e.g., received as user input, received from a remote user, received from a data file, etc.). A text string can be separated from a continuous text stream through various delimiting techniques described below. Text strings can be included in, for example, a document, a spread sheet, or a message (e.g., e-mail, SMS, instant message, etc.) as a paragraph, a sentence, a phrase, a word, a partial word (i.e., sub-word), phonetic segment and the like. Text strings can include, for example, ASCII or Unicode characters or other representations of words. In one implementation, application 110 includes a portion of synthesis block 130 (e.g., a daemon or capture routine) to identify and initially process text strings for output. In another implementation, application 110 provides a designation for speech output of associated text strings (e.g., enable/disable button).

Operating system 120 can output text strings to synthesis block 130. The text strings can be generated within operating system 120 or be passed from application 110. Operating system 120 can be, for example, a MAC OS X operating system by Apple Computer, Inc. of Cupertino, Calif., a Microsoft Windows operating system, a mobile operating system (e.g., Windows CE or Palm OS), control software, a cellular telephone control software, and the like. Operating system 120 may generate text strings related to user interactions (e.g., responsive to a user selecting an icon), states of user hardware (e.g., responsive to low battery power or a system shutting down), and the like. In some implementations, a portion or all of synthesis block 130 is integrated within operating system 120. In other implementations, synthesis block 130 interrogates operating system 120 to identify and provide text strings to synthesis block 130.

More generally, a kernel layer (not shown) in operating system 120 can be responsible for general management of system resources and processing time. A core layer can provide a set of interfaces, programs and services for use by the kernel layer. For example, a core layer can manage interactions with application 110. A user interface layer can include APIs (Application Program Interfaces), services and programs to support user applications. For example, a user interface can display a UI (user interface) associated with application 110 and associated text strings in a window or panel. One or more of the layers can provide text streams or text strings to synthesis block 130.

Synthesis block 130 receives text strings or text string information as described. Synthesis block 130 is also in communication with audio segments 135 and D/A converter 140. Synthesis block 130 can be, for example, a software program, a plug-in, a daemon, or a process and include one or more engines for parsing and correlation functions as discussed below in association with FIG. 2. In one implementation, synthesis block 130 can be executed on a dedicated software thread or hardware thread. Synthesis block 130 can be initiated at boot-up, by application, explicitly by a user or by other means. In general, synthesis block 130 provides a combination of audio samples corresponding to text strings. At least some of the audio samples can be selected to include properties or have relationships with other audio samples in order to provide a natural sounding (i.e., less machine-like) combination of audio samples. Further details in association with synthesis block 130 are given below.

Audio storage 135 can be, for example, a database or other file structure stored in a memory device (e.g., hard drive, flash drive, CD, DVD, RAM, ROM, network storage, audio tape, and the like). Audio storage 135 includes a collection of audio segments and associated metadata (e.g., properties). Individual audio segments can be sound files of various formats such as AIFF (Apple Audio Interchange File Format Audio) by Apple Computer, Inc., MP3, MIDI, WAV, and the like. Sound files can be analog or digital and recorded at frequencies such as 22 khz, 44 khz, or 96 khz and, if digital, at various bit rates.

D/A converter 140 receives a combination of audio samples from synthesis block 130. D/A converter 140 produces analog or digital audio information to speaker 145. In one implementation, D/A converter 140 can provide post-processing to a combination of audio samples to improve sound quality. For example, D/A converter 140 can normalize volume levels or pitch rates, perform sound decoding or formatting, and other signal processing.

Speakers 145 can receive audio information from D/A converter 140. The audio information can be pre-amplified (e.g., by a sound card) or amplified internally by speakers 145. In one implementation, speakers 145 produce speech generated by synthesized by synthesis block 130 and cognizable by a human. The speech can include articulation relationships between individual units of sound or other properties that produce more human like speech.

Figure 2:
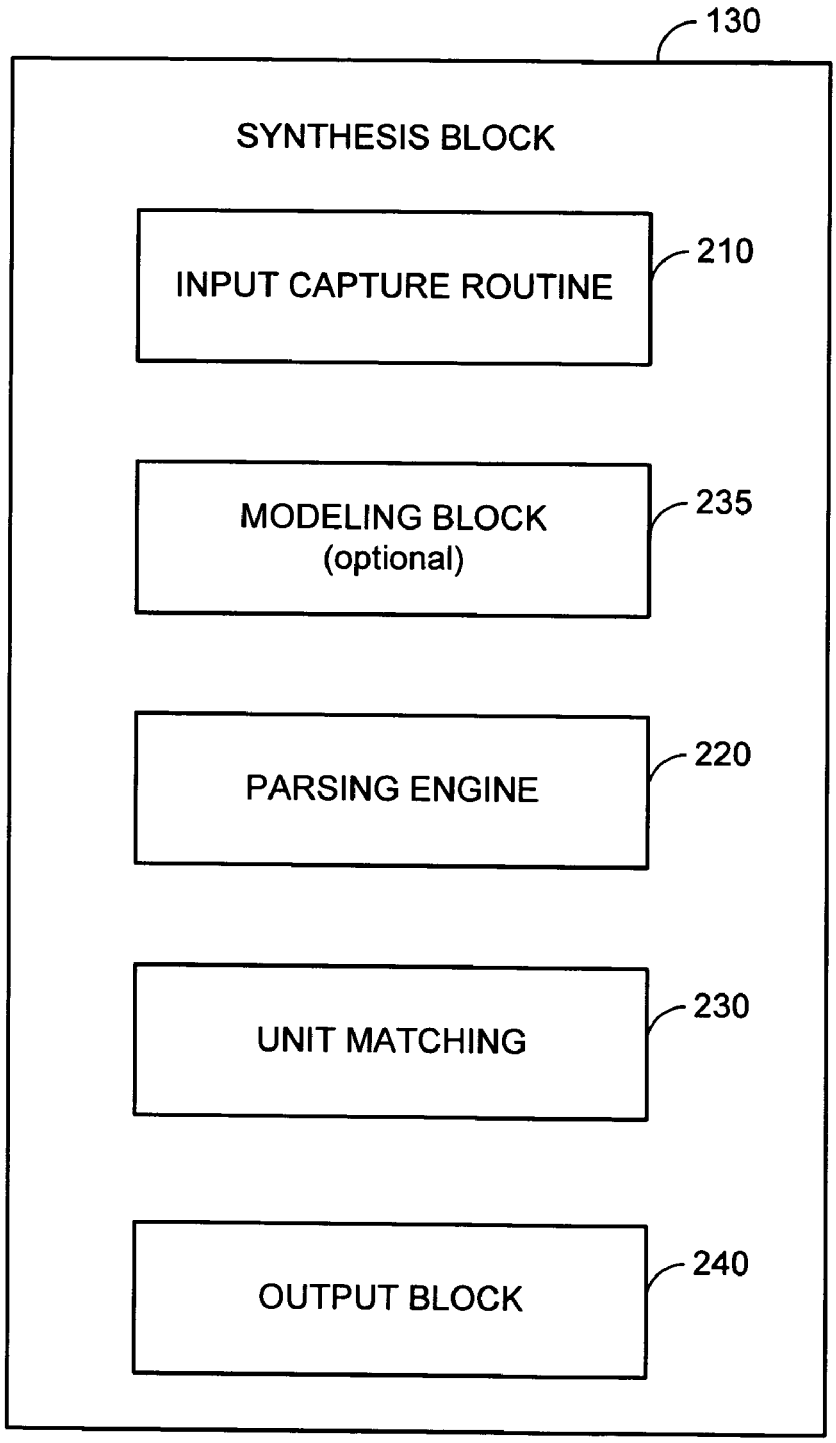
FIG. 2 is a block diagram illustrating a synthesis block of the proposed system of FIG. 1.

FIG. 2 is a more detailed block diagram illustrating synthesis block 130. Synthesis block 130 includes an input capture routine 210, a parsing engine 220, a unit matching engine 230, an optional modeling block 235 and an output block 240.

Input capture routine 210 can be, for example, an application program, a module of an application program, a plug-in, a daemon, a script, or a process. In some implementations, input capture routine 210 is integrated within operating system 120. In some implementations, input capture routine 210 operates as a separate application program. In general, input capture routine 210 monitors, captures, identifies and/or receives text strings or other information for generating speech.

Parsing engine 220, in one implementation, delimits a text stream or text string into units. For example, parsing engine 220 can separate a text string into phrase units, phrase units into word units, word units into sub-word units, and/or sub-word units into phonetic segment units (e.g., a phoneme, a diphone (phoneme-to-phoneme transition), a triphone (phoneme in context), a syllable or a demisyllable (half of a syllable) or other similar structure). The hierarchy of units described can be relative and depend on surrounding units. For example, the phrase "the cat sat on the mattress," can be divided into phrases (i.e., grammatical phrase units (see FIG. 5)). Phrase units can be further divided into word units for each word (e.g., phrases divided as necessary into a single word). In addition, word units can be divided into a phonetic segment units or sub-word units (e.g., a single word divided into phonetic segments). Various forms of text string units such as division by tetragrams, trigrams, bigrams, unigrams, phonemes, diphones, and the like, can be implemented to provide a specific hierarchy of units, with the fundamental unit level being a phonetic segment or other sub-word unit. Examples of unit hierarchies are discussed in further detail below. Parsing engine 220 analyzes units to determine properties and relationships and generates information describing the same. The analysis is described in greater detail below.

Unit matching engine 230, in one implementation, matches units from a text string to audio segments at a highest possible level in a unit hierarchy. Matching can be based on both a textual match as well as property matches. A textual match will determine the group of audio segments that correspond to a given textual unit. Properties of the prior or following synthesized audio segment, and the proposed matches can be analyzed to determine a best match. Properties can include those associated with the unit and concatenation costs. Unit costs can include considerations of one or more of pitch, duration, accentuation, and spectral characteristics. Unit costs measure the similarity or difference from an ideal model. Predictive models can be used to create ideal pitch, duration etc. predictors that can be used to evaluate which unit from a group of similar units (i.e., similar text unit but different audio sample) should be selected. Models are discussed more below in association with modeling block 235. Concatenation costs can include those associated with articulation relationships such as adjacency between units in samples. Concatenation costs measure how well a unit fits with a neighbor unit. In some implementations, segments can be analyzed grammatically, semantically, phonetically or otherwise to determine a best matching segment from a group of audio segments. Metadata can be stored and used to evaluate best matches. Unit matching engine 230 can search the metadata in audio storage 135 (FIG. 1) for textual matches as well as property matches. If a match is found, results are produced to output block 240. If match is not found, unit matching engine 230 submits the unmatched unit back to parsing engine 220 for further parsing/processing (e.g., processing at different levels including processing smaller units). When a text string portion cannot be divided any further, an uncorrelated or raw phoneme or other sub-word unit can be produced to output block 240. Further details of one implementation of unit matching engine 230 are described below in association with FIG. 7.

Modeling block 235 produces ideal models that can be used to analyze segments to select a best segment for synthesis. Modeling block 235 can create predictive models that reflect ideal pitch, duration etc. Based on the models, a selection of a best matching segment can be made.

Output block 240, in one implementation, combines audio segments. Output block 240 can receive a copy of a text string received from input capture routine 210 and track matching results from the unit hierarchy to the text string. More specifically, phrase units, word units, sub-word units, and phonetic segments (units), etc., can be associated with different portions of a received text string. The output block 240 produces a combined output for the text string. Output block 240 can produce combined audio segments in batch or on-the-fly.

Figure 3A:
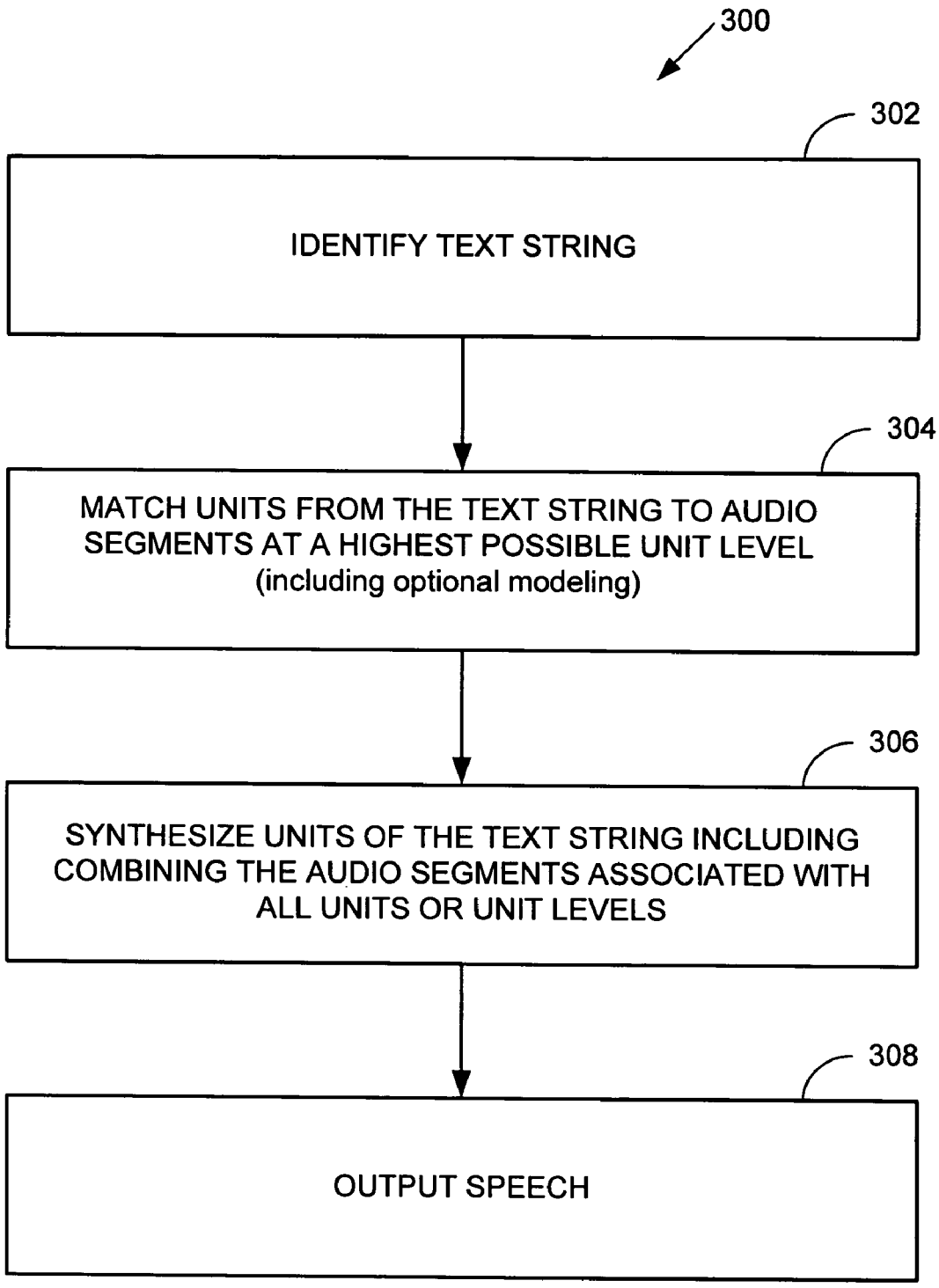
FIG. 3A is a flow diagram illustrating one method for synthesizing text into speech.

FIG. 3A is a flow diagram illustrating a method 300 for synthesizing text to speech. A precursor to the synthesizing process 300 includes the processing and evaluation of training audio samples and storage of such along with attending property information. The precursor process is discussed in greater detail in association with FIG. 4.

A text string is identified 302 for processing (e.g., by input capture routine 210). In response to boot-up of the operating system or launching of the application, for example, input text strings from various sources can be monitored and identified. The input strings can be, for example, generated by a user, sent to a user, or displayed from a file.

Units from the text string are matched 304 to audio segments, and in one implementation to audio segments at a highest possible unit level. In general, when units are matched at a high level, more articulation relationships will be contained within an audio segment. Higher level articulation relationships can produce more natural sounding speech. When lower level matches are needed, an attempt is made to parse units and match appropriate articulation relationships at a lower level. More details about one implementation for the parsing and matching processes are discussed below in association with FIG. 7.

Units are identified in accordance with a parsing process. In one implementation, an initial unit level is identified and the text string is parsed to find matching audio segments for each unit. Each unmatched unit then can be further processed. Further processing can include further parsing of the unmatched unit, or a different parsing of the unmatched unit, the entire or a portion of the text string. For example, in one implementation, unmatched units are parsed to a next lower unit level in a hierarchy of unit levels. The process repeats until the lowest unit level is reached or a match is identified. In another implementation, the text string is initially parsed to determine initial units. Unmatched units can be re-parsed. Alternatively, the entire text string can be re-parsed using a different rule and results evaluated. Optionally, modeling can be performed to determine a best matching unit. Modeling is discussed in greater detail below.

Units from the input string are synthesized 306 including combining the audio segments associated with all units or unit levels. Speech is output 308 at a (e.g., amplified) volume. The combination of audio segments can be post-processed to generate better quality speech. In one implementation, the audio segments can be supplied from recordings under varying conditions or from different audio storage facilities, leading to variations. One example of post-processing is volume normalization. Other post-processing can smooth irregularities between the separate audio segments.

Figure 3B:
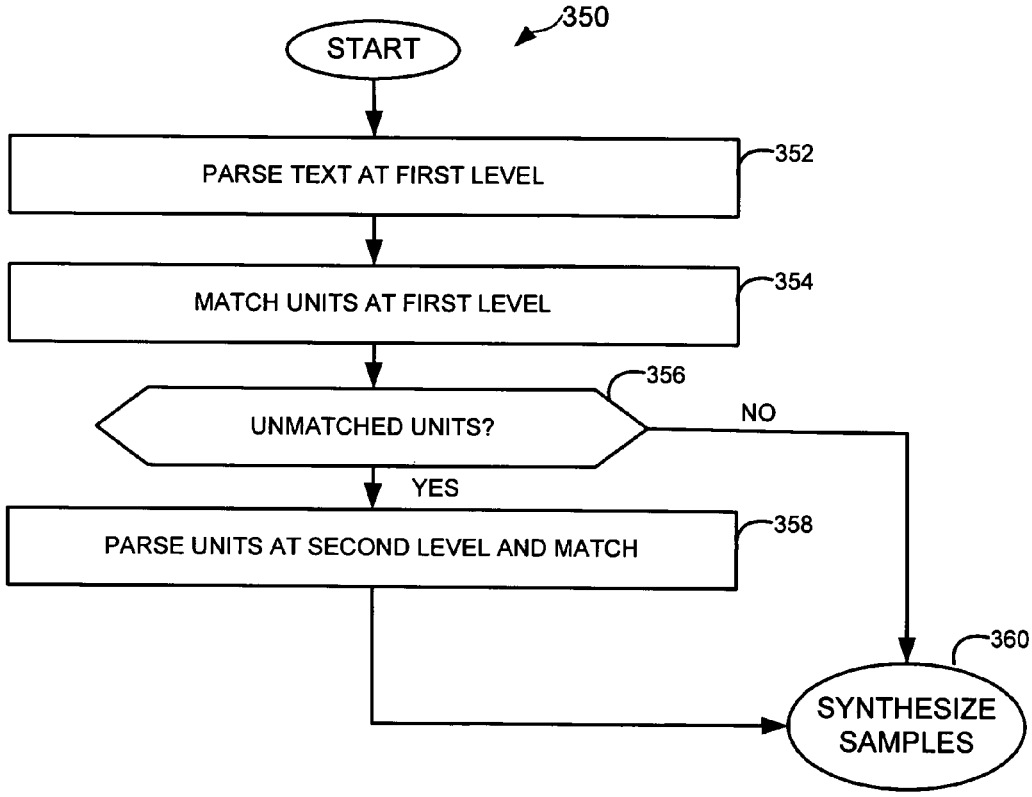
FIG. 3B is a flow diagram illustrating a second method for synthesizing text into speech.

Referring to FIG. 3B another implementation for processing speech is shown. In this method 350, received textual materials are parsed at a first level (352). The parsing of the textual materials can be for example at the phrase unit level, word unit, level, sub-word unit level or other level. A match is attempted to be located for each unit (354). If no match is located for a given unit (356), the unmatched unit is parsed again at a second unit level (358). The second unit level can be smaller in size than the first unit level and can be at the word unit level, sub-word unit level, diphone level, phoneme level or other level. After parsing, a match is made to a best unit. The matched units are thereafter synthesized to form speech for output (360). Details of a particular matching process at multiple levels are discussed below.

Figure 4:
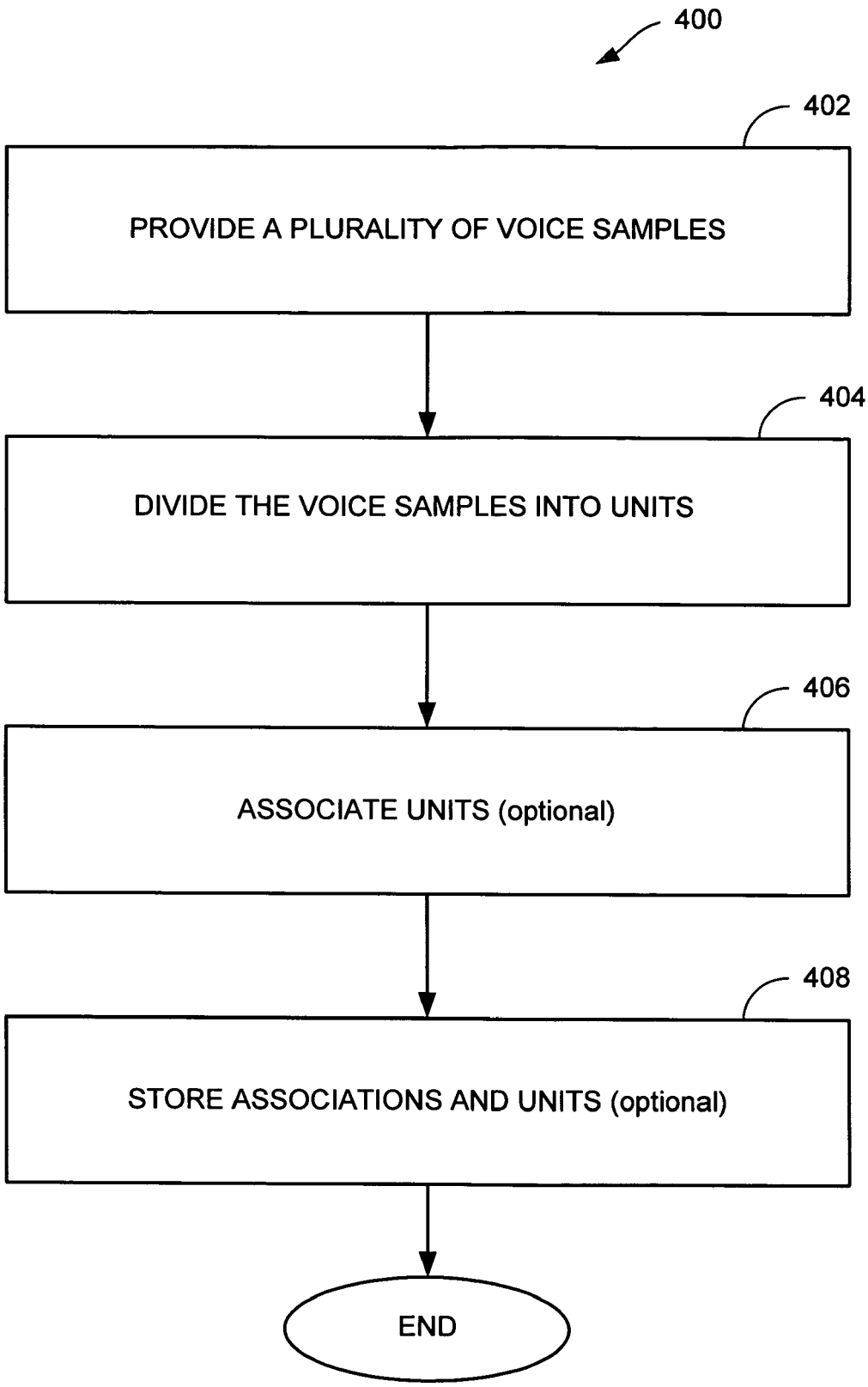
FIG. 4 is a flow diagram illustrating a method for providing a plurality of audio segments having defined properties that can be used in the method shown in FIG. 3.

Prior to matching and synthesis, a corpus of audio samples must be received, evaluated, and stored to facilitate the matching process. The audio samples are required to be divided into unit levels creating audio segments of varying unit sizes. Optional analysis and linking operations can be performed to create additional data (metadata) that can be stored along with the audio segments. FIG. 4 is a flow diagram illustrating one implementation of a method 400 for providing audio segments and attending metadata. Voice samples of speech are provided 402 including associated text. A human can speak into a recording device through a microphone or prerecorded voice samples are provided for training. Optimally one human source is used but output is provided under varied conditions. Different samples can be used to achieve a desired human sounding result. Text corresponding to the voice samples can be provided for accuracy or for more directed training. In another implementation, audio segments can be computer-generated and a voice recognition system can determine associated text from the voice samples.

The voice samples are divided 404 into units. The voice sample can first be divided into a first unit level, for example into phrase units. The first unit level can be divided into subsequent unit levels in a hierarchy of units. For example, phrase units can be divided into other units (words, subwords, diphones, etc.) as discussed below. In one implementation, the unit levels are not hierarchical, and the division of the voice samples can include division into a plurality of units at a same level (e.g., dividing a voice sample into similar sized units but parsing at a different locations in the sample). In this type of implementation, the voice sample can be parsed a first time to produce a first set of units. Thereafter, the same voice sample can be parsed a second time using a different parsing methodology to produce a second set of units. Both sets of units can be stored including any attending property or relationship data. Other parsing and unit structures are possible. For example, the voice samples can be processed creating units at one or more levels. In one implementation, units are produced at each level. In other implementations, only units at selected levels are produced.

Figure 5:
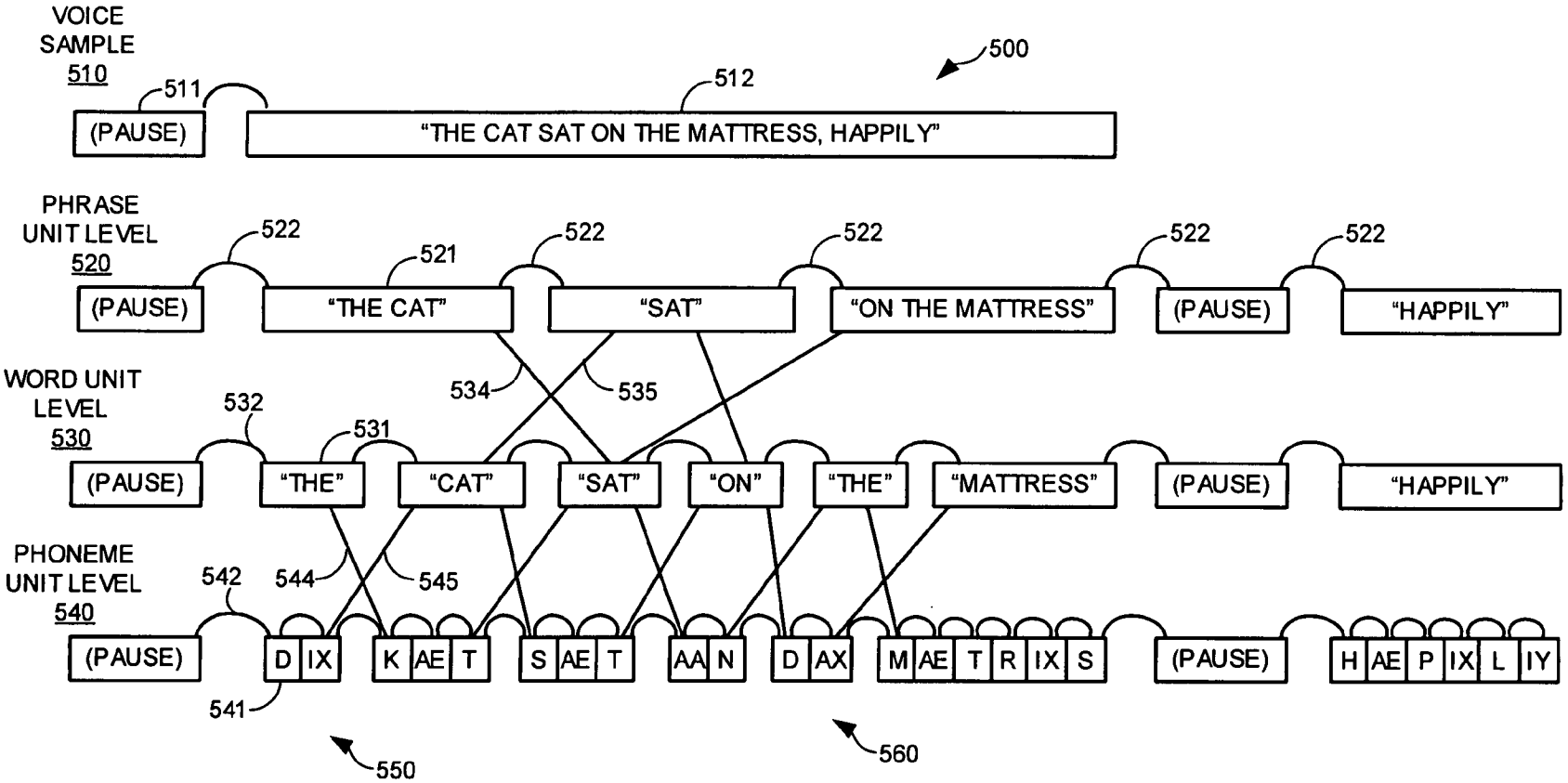
FIG. 5 is a schematic diagram illustrating linked segments.
Figure 6:
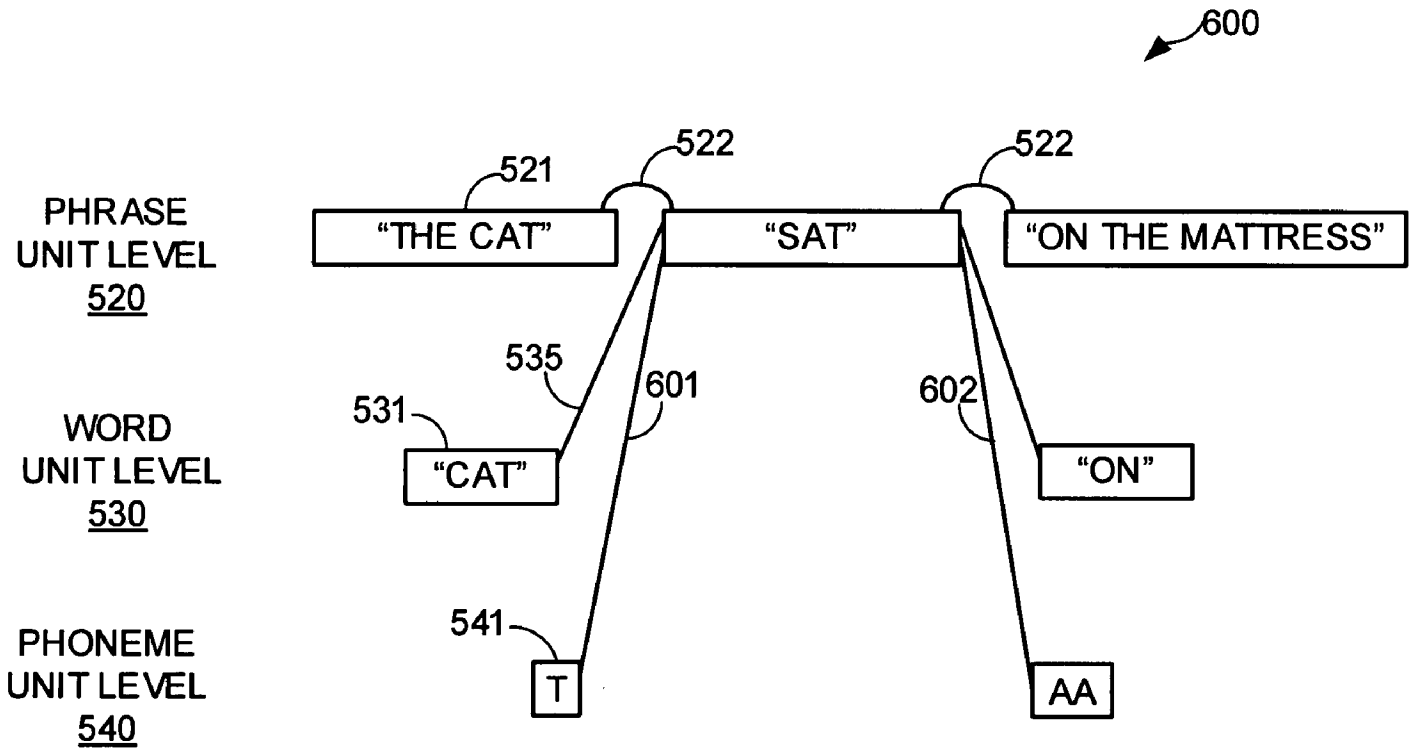
FIG. 6 is a schematic diagram illustrating another example of linked segments.

In some implementations, the units are analyzed for associations and properties 406 and the units and attending data (if available) stored 408. Analysis can include determining associations, such as adjacency, with other units in the same level or other levels. Examples of associations that can be stored are shown in FIGS. 5 and 6. Other analysis can include analysis associated with pitch, duration, accentuation, spectral characteristics, and other features of individual units or groups of units. Analysis is discussed in greater details below. In the end of the sample processing, each unit, including representative text, associated segment, and metadata (if available) is stored for potential matching.

For example, FIG. 5 is a schematic diagram illustrating a voice sample that is divided into units on different levels. A voice sample 510 including the phrase 512 "the cat sat on the mattress, happily" is separated by pauses 511. Voice sample 510 is divided into phrase units 521 including the text "the cat," "sat," "on the mattress" and "happily." Phrase units 521 are further divided into word units 531 including the text "the", "cat" and others. The last unit level of this example is a phonetic segment unit level 540 that includes units 541 which represent word enunciations on an atomic level. For example, the sample word "the" consists of the phonemes "D" and "IX". A second, instance of the sample word "the" consists of the phonemes "D" and "AX". The difference stems from a stronger emphasis of the word "the" in speech when beginning a sentence or after a pause. These differences can be captured in metadata (e.g., location or articulation relationship data) associated with the different voice samples (and be used to determine which segment to select from plural available similar segments).

As discussed in FIG. 4, associations between units can be captured in metadata and saved with the individual audio segments. The associations can include adjacency data between and across unit levels. In FIG. 5, three levels of unit associations are shown (phrase unit level 520, word unit level 530 and phonetic segment unit level 540). In FIG. 5, on a phrase unit level 520, peer level associations 522 link phrase units 521. Between phrase unit level 520 and word unit level 530, inter-level associations 534, 535 link, for example, a phrase unit 521 with word unit 531. Similarly, on word unit level 530 and a phonetic segment unit level 540, peer level associations 532, 542 link word units 531 and phonetic segment units 541, respectively. Moreover, between word unit level 530 and phonetic segment unit level 540, inter-level associations 544, 545 link, for example, phoneme units 541 and word unit 531. In FIG. 6, the phrase unit 521 "sat" is further linked to units 541 "T" and AA" through inter-level associations 601 and 602 providing linking between non-adjacent levels in the hierarchy.

As described above, associations can be stored as metadata corresponding to units. In one implementation, each phrase unit, word unit, sub-word unit, phonetic segment unit, etc., can be saved as a separate audio segment. Additionally, links between units can be saved as metadata. The metadata can further indicate whether a link is forward or backward and whether a link is between peer units or between unit levels.

Figure 7:
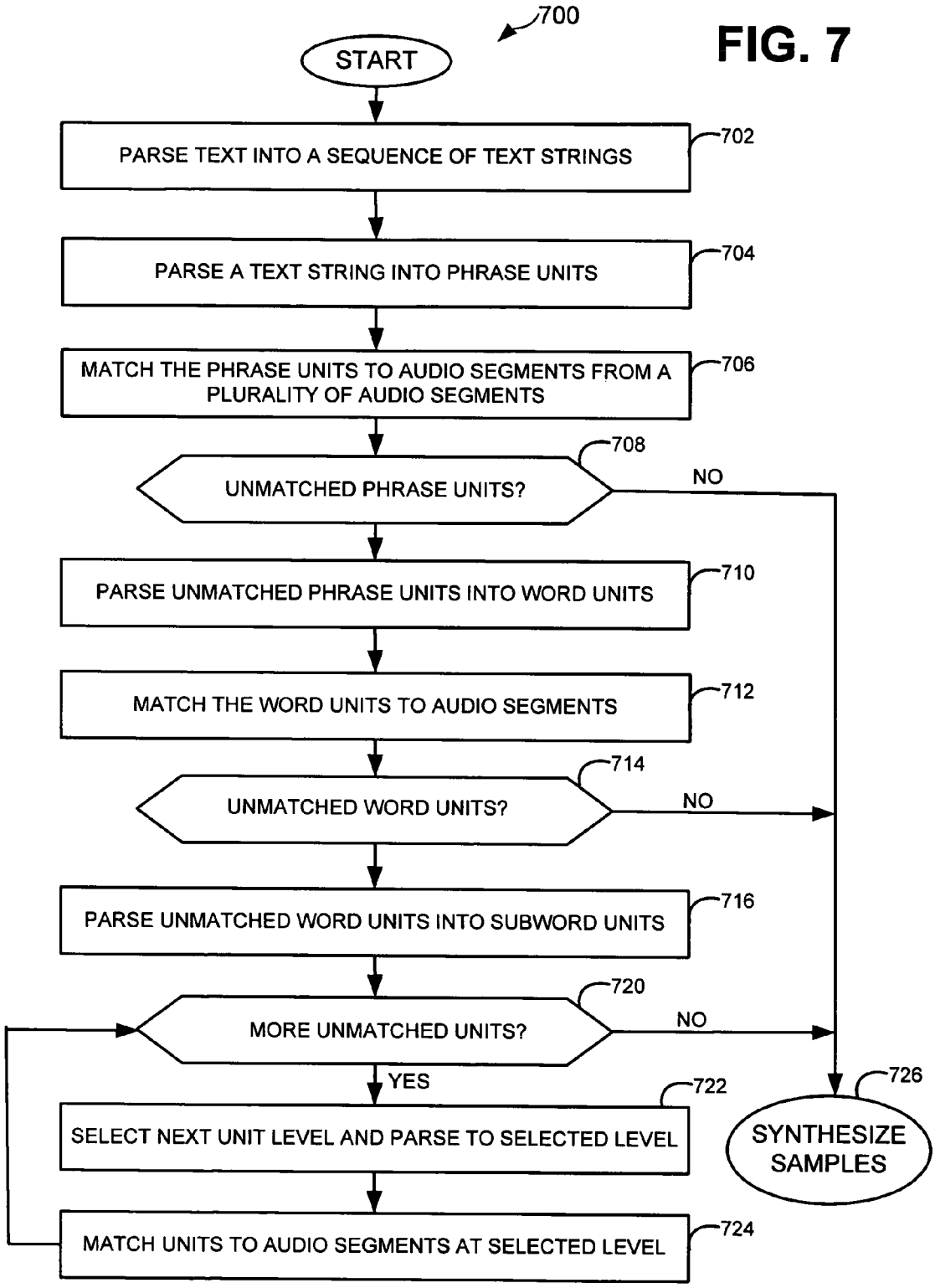
FIG. 7 is a flow diagram illustrating a method for matching units from a stream of text to audio segments at a highest possible unit level.

As described above, matching can include matching portions of text defined by units with segments of stored audio. The text being analyzed can be divided into units and matching routines performed. One specific matching routine includes matching to a highest level in a hierarchy of unit levels. FIG. 7 is a flow diagram illustrating a method 700 for matching units from a text string to audio segments at a highest possible unit level. A text stream (e.g., continuous text stream) is parsed 702 into a sequence of text strings for processing. In one implementation, a text stream can be divided using grammatical delimiters (e.g., periods, and semi-colons) and other document delimiters (e.g., page breaks, paragraph symbols, numbers, outline headers, and bullet points) so as to divide a continuous or long text stream into portions for processing. In one implementation, the portions for processing represent sentences of the received text.

Each text string (e.g., each sentence) is parsed 704 into phrase units (e.g., by parsing engine 220). In one implementation, a text string itself can comprise a phrase unit. In other implementations, the text string can be divided, for example, into a predetermined number of words, into recognizable phrases, word pairs, and the like. The phrase units are matched 706 to audio segments from a plurality of audio segments (e.g., by unit matching engine 230). To do so, an index of audio segments (e.g., stored in audio storage 135) can be accessed. In one implementation, metadata describing the audio segments is searched. The metadata can provide information about articulation relationships, properties or other data of a phrase unit as described above. For example, the metadata can describe links between audio segments as peer level associations or inter-level associations (e.g., separated by one level, two levels, or more). For the most natural sounding speech, a highest level match (i.e., phrase unit level) is preferable.

More particularly, the first unit in the text string is processed and attempted to be matched to a unit at, for example, the phrase unit level. If no match is determined, then the unit may be further parsed to create other units, a first of which is attempted to be matched. The process continues until a match occurs or no further parsing is possible (i.e., parsing to the lowest possible level has occurred or no other parsing definitions have been provided). In one implementation, a match is guaranteed as the lowest possible level is defined to be at the phoneme unit level. Other lowest levels are possible. Once a match of the first unit is complete, an appropriate audio segment is identified for synthesis. Subsequent units in the text string are processed at the first unit level (e.g., phrase unit level) in a similar manner.

Matching can include the evaluation of a plurality of similar (i.e., same text) units having different audio segments (e.g., different accentuation, different duration, different pitch, etc.). Matching can include evaluating data associated with a candidate unit (e.g., metadata) and evaluation of prior and following units that have been matched (e.g., evaluating the previous matched unit to determine what if any relationships or properties are associated with this unit). Matching is discussed in more detail below.

Returning to the particular implementation shown in FIG. 7, if there are unmatched phrase units 708, the unmatched phrase units are parsed 710 into word units. For example, phrase units that are word pairs can be separated into separate words. The word units are matched 712 to audio segments. Again, matches are attempted at a word unit level and, if unsuccessful, at a lower level in the hierarchy as described below.

If there are unmatched word units 714, the unmatched word units are parsed 716 into sub-word units. For example, word units can be parsed into words, having suffixes or prefixes. If no unmatched units remain 720 (at this or any level), the matching process ends and synthesis of the text samples can be initiated (726). Else the process can continue at a next unit level 722. At each unit level, a check is made to determine if a match has been located 724. If no match is found, the process continues including parsing to a new lower level in the hierarchy until a final unit level is reached 720. If unmatched units remain after all other levels have been checked, then uncorrelated phonemes can be output.

In one implementation, a check is added in the process after matches have been determined (not shown). The check can allow for further refinement in accordance with separate rules. For example, even though a match is located at one unit level, it may be desirable to check to at a next or lower unit level for a match. The additional check can include user input to allow for selection from among possible match levels. Other check options are possible.

Figure 8:
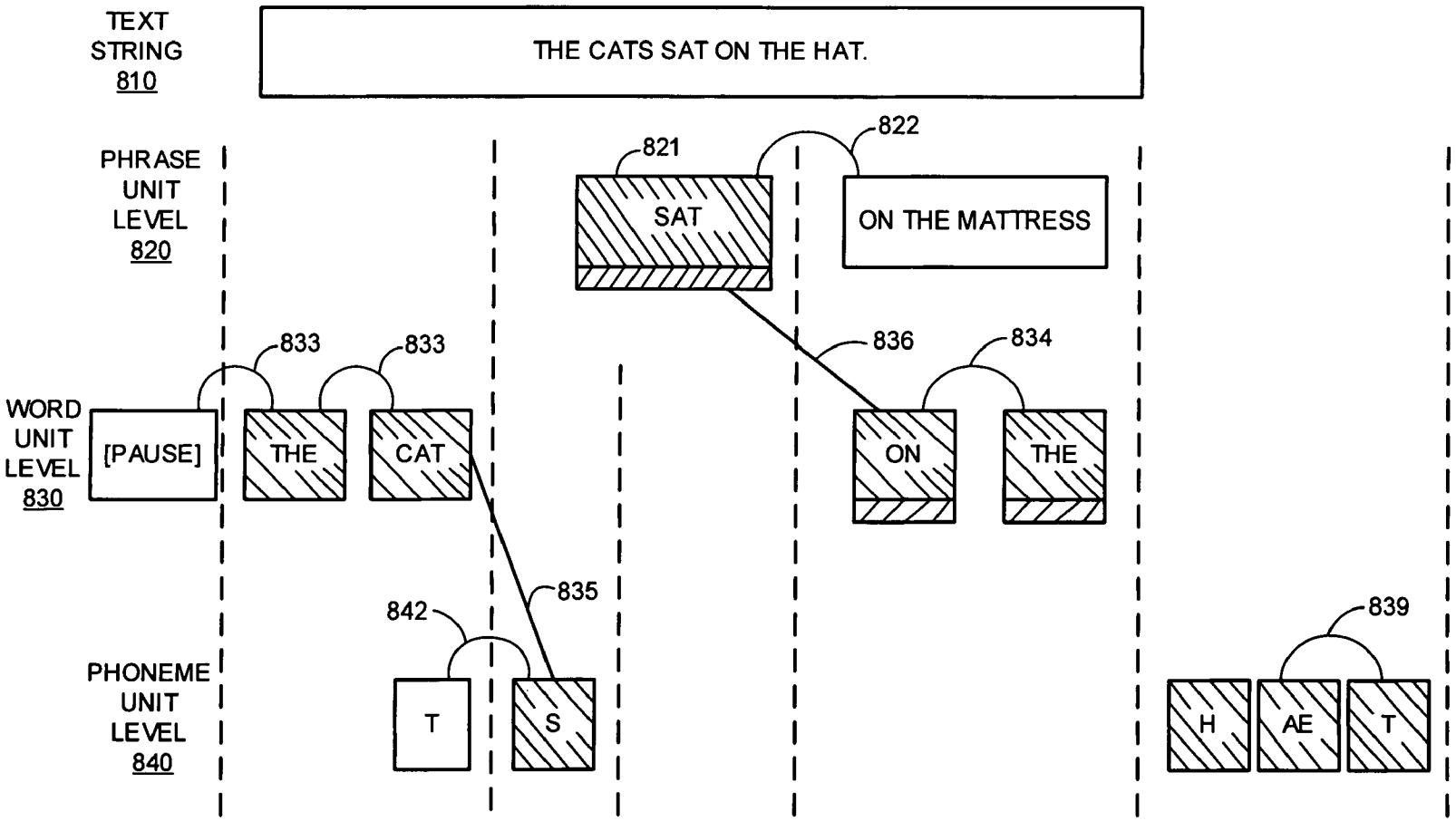
FIG. 8 is a schematic diagram illustrating linked segments.

FIG. 8 is a schematic diagram illustrating an example of a matching process. The text string 810 that is to be processed is "The cats sat on the hat." For the purposes of this example, the only searchable/matchable units that are available are those associated with the single training sample "the cat sat on the mattress" described previously. Text string 810 is parsed using grammatical delimiters indicative of a sentence (i.e., first letter capitalization and a period). On a phrase unit level 820, text string 810 is divided into phrases. After being unable to match the phrase "the cats" at phrase unit level 820, a search for individual words is made at a word unit level 830. The word "the" 832 is found. Furthermore, metadata 833 can be used to identify a particular instance of "the" that is, for example, preceded by a pause and followed by the word "cat" (in this example the training sample includes the prior identified phrase "the cat sat on the mattress", which would produce at the word level a "the" unit that is preceded by a pause and followed by the word "cat", hence making this a potentially acceptable match).

Although the word "cats" is not found, the word "cat" can be converted to a plural by adding the phoneme "S" (i.e., at the phoneme level 840). Moreover, metadata 835, 842 can be used to identify a particular instance of "S" that is preceded by a "T", consistent with the word "cat." The phrase "sat" is identified with a subsequent phrase or word beginning with the word "on" (two such examples exist in the corpus example, including metadata links 822 and 836). The phrase "the" is identified at the word unit level including an association 834 with a prior word "on". In this example (where only a single training sample is available) because the word "hat" has no match, lowest level units are used for matching this word, for example, at the phonetic segment unit level 840. Within the lower level units, an association 831 between "AE" and "T" is identified, similar to the phonetic units associated with the training word "cat". The remaining phonemes are uncorrelated. The combined units at the respective levels can be output as described above to produce the desired audio signal.

Matching and Properties

As described above, properties of units can be stored for matching purposes. Examples of properties include adjacency, pitch contour, accentuation, spectral characteristics, span (e.g., whether the instance spans a silence, a glottal stop, or a word boundary), grammatical context, position (e.g., of word in a sentence), isolation properties (e.g., whether a word can be used in isolation or needs always to be preceded or followed by another word), duration, compound property (e.g., whether the word is part of a compound, other individual unit properties or other properties. After parsing, evaluation of the unit, and adjoining units in the text string, can be performed to develop additional data (e.g., metadata). As described above, the additional data can allow for better matches and produce better end results. Alternatively, only units (e.g., text and audio segments alone) without additional data can be stored.

In one implementation, three unit levels are created including phrases, words and diphones. In this implementation, for each diphone unit one or more of the following additional data is stored for matching purposes:

- The pitch contour of the instance, i.e., whether pitch rises, falls, has bumps, etc.
- The accentuation of the phoneme that the instance overlaps, whether it is accentuated or not.
- The spectral characteristics of the border of the instance, i.e. what acoustic contexts it is most likely to fit in.
- Whether the instance spans a silence, a glottal stop, or a word boundary.
- The adjacent instances, which allows the system to know what we want to know about the phonetic context of the instance.

In this implementation, for each word unit, one or more of the following additional data is stored for matching purposes:

- The grammatical (console the child vs. console window) and semantic (bass fishing vs. bass playing) context of the word.
- The pitch contour of the instance, i.e., whether pitch rises, falls, has bumps, etc.
- The accentuation of the instance, whether it is accentuated or not.
- The position of the word in the phrase it was originally articulated (beginning, middle, end, before a comma, etc.).
- Whether the word can be used in an arbitrary context (or needs to always precede or follow its immediate neighbor).
- Whether the word was part of a compound, i.e. the "fire" in "firefighter".

In this implementation, for each phrase unit, adjacency data can be stored for matching purposes. The adjacency data can be at a same or different unit level.

The invention and all of the functional operations described herein can be implemented in digital electronic circuitry, or in computer hardware, firmware, software, or in combinations of them. The invention can be implemented as a computer program product, i.e., a computer program tangibly embodied in an information carrier, e.g., in a machine-readable storage device or in a propagated signal, for execution by, or to control the operation of, data processing apparatus, e.g., a programmable processor, a computer, or multiple computers. A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a communication network.

Method steps of the invention can be performed by one or more programmable processors executing a computer program to perform functions of the invention by operating on input data and generating output. Method steps can also be performed by, and apparatus of the invention can be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for executing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. Information carriers suitable for embodying computer program instructions and data include all forms of non-volatile memory, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in special purpose logic circuitry.

To provide for interaction with a user, the invention can be implemented on a device having a display, e.g., a CRT (cathode ray tube) or LCD (liquid crystal display) monitor, for displaying information to the user and an input device, e.g., a keyboard, a mouse, a trackball, and the like by which the user can provide input to the computer. Other kinds of devices can be used to provide for interaction with a user as well; for example, feedback provided to the user can be any form of sensory feedback, e.g., visual feedback, auditory feedback provided by speakers associated with a device, externally attached speakers, headphones, and the like, or tactile feedback; and input from the user can be received in any form, including acoustic, speech, or tactile input.

The invention can be implemented in, e.g., a computing system, a handheld device, a telephone, a consumer appliance, a multimedia player or any other processor-based device. A computing system implementation can include a back-end component, e.g., as a data server, or that includes a middleware component, e.g., an application server, or that includes a front-end component, e.g., a client computer having a graphical user interface or a Web browser through which a user can interact with an implementation of the invention, or any combination of such back-end, middleware, or front-end components. The components of the system can be interconnected by any form or medium of digital data communication, e.g., a communication network. Examples of communication networks include a local area network ("LAN") and a wide area network ("WAN"), e.g., the Internet.

The computing system can include clients and servers. A client and server are generally remote from each other and typically interact through a communication network. The relationship of client and server arises by virtue of computer programs running on the respective computers and having a client-server relationship to each other.

A number of implementations have been described. Nevertheless, it will be understood that various modifications may be made. For example, though three or four specific unit levels were described above in the context of the synthesis process, other numbers and kinds of levels can be used. Accordingly, other implementations are within the scope of the following claims.

What is claimed is:

1. A method, including:

matching, using a processor, phrase units of a received input string to audio segments from a plurality of audio segments including, for each phrase unit, matching the phrase unit to an audio segment using properties of the phrase unit in comparison to properties of other units in a hierarchy of units including phrases and words and using articulation relationships between the phrase unit and the other units to locate matching audio segments from a plurality of selections including determining concatenation costs and unit costs, where concatenation costs measure how well a unit fits with a neighbor unit and unit costs measure a similarity or difference from an ideal model;

identifying unmatched phrase units that are not matched to audio segments;

parsing the unmatched phrase units into word units;

matching the word units to audio segments including, for each word unit, matching a word unit to an audio segment using properties of the word unit in comparison to properties of other units in the hierarchy of units including the phrases and the words and using articulation relationships between the word and the other units to locate matching audio segments from the plurality of selections; and synthesizing the received input string including combining the audio segments associated with the matching phrase units and the matching word units.

2. The method of claim 1, wherein matching the phrase units further comprises:

searching metadata associated with the plurality of audio segments and that describes the properties of or between the plurality of audio segments.

3. The method of claim 1, wherein matching the word units further comprises:

searching metadata associated with the plurality of audio segments and that describes the properties of or between the plurality of audio segments.

4. The method of claim 1, further comprising:

parsing unmatched word units into sub-word units; and matching the sub-word units to audio segments including searching metadata associated with the plurality of audio segments and that describes properties of or between the plurality of audio segments.

5. The method of claim 1, further comprising:

parsing unmatched word units into phonetic segment units; and matching the phonetic segment units to audio segments including searching metadata associated with the plurality of audio segments and that describes properties of or between the plurality of audio segments.

6. The method of claim 5, wherein synthesizing the input string includes:

combining the audio segments associated with phrase, word, sub-word and phonetic segment units.

7. The method of claim 1, further comprising:

providing an index to the plurality of audio segments.

8. The method of claim 1, further comprising:

generating metadata associated with the plurality of audio segments.

9. The method of claim 8, wherein generating the metadata comprises:

receiving a voice sample;

determining two or more portions of the voice sample having properties; and generating a portion of the metadata associated with a first portion of the voice sample to associate a second portion of the voice sample, and a portion of the metadata associated with the second portion of the voice sample to associate the first portion of the voice sample.

10. The method of claim 8, wherein generating the metadata comprises:

receiving a voice sample;

delimiting a portion of the voice sample in which articulation relationships are substantially self-contained; and generating a portion of the metadata to describe the portion of the voice sample.

11. The method of claim 1, wherein the phrase units each comprise one or more of one or more sentences, one or more phrases, one or more word pairs, or one or more words.

12. The method of claim 1, wherein the input string is received from an application or an operating system.

13. The method of claim 1, further comprising:

transforming unmatched portions of the input string to uncorrelated phonemes.

14. The method of claim 1, wherein the input string comprises ASCII or Unicode characters.

15. The method of claim 1, further comprising:

outputting amplified speech comprising the combined audio segments.

16. A method, including:

receiving a stream of textual input;

matching portions of the stream of textual input to audio segments derived from one or more voice samples at multiple levels including:

matching the portions based on properties of individual portions and articulation relationships between the portions; and comparing the portions to target voice samples at different hierarchical levels to identify matched portions where the hierarchical levels are selected from a group comprising target matching phrases, words, sub-words and phonetic segments;

identifying unmatched portions that are not matched to the audio segments;

parsing portions including the unmatched portions using a hierarchical level different from that used for matching the target voice samples;

comparing the parsed portions to the audio segments to identify additional matched portions; and synthesizing audio segments corresponding to the matched portions and the additional matched portions into speech output.

17. The method of claim 16, wherein synthesizing comprises:

synthesizing both matching audio segments for successfully matched portions of the stream of textual input and uncorrelated phonemes for unmatched portions of the stream of textual input.

18. A non-transitory computer program product including instructions tangibly stored on a computer-readable medium, the product including instructions for causing a computing device to:

match, by a processor, phrase units of an input string to audio segments from a plurality of audio segments;

identify unmatched phrase units that are not matched to the audio segments;

parse the unmatched phrase units into word units;

match the word units to audio segments including, for word units adjacent to matched phrase units in the input string, matching the word units based on properties of the word units and the adjacent matched phrase units; and synthesize the input string including combining the audio segments associated with the matching phrase units and the matching word units.

19. A system, including:

an input capture routine to receive an input string that includes phrase units;

a unit matching engine, in communication with the input capture routine, to match the phrase units to audio segments from a plurality of audio segments including using properties of or between the audio segments for matching the phrase units, and to identify unmatched phrase units that are not matched to the audio segments;

a parsing engine, in communication with the unit matching engine, to parse unmatched phrase units into word units, the unit matching engine configured to match the word units to audio segments including using properties of the audio segments associated with the word units and audio segments associated with adjacent phrase units;

a synthesis block, in communication with the unit matching engine, to synthesize the input string including combining the audio segments associated with the phrase units and the word units; and a storage unit to store the plurality of audio segments and properties of or between the plurality of audio segments.

20. A method including providing, by a processor, a library of audio segments and associated metadata defining properties of or between a given segment and another segment, the library including one or more levels of units in accordance with a hierarchy;

matching, at a first level of the hierarchy, units of a received input string to audio segments, the received input string having one or more units at a first level;

identifying unmatched units that are not matched to the audio segments;

parsing the unmatched units to units at a second level in the hierarchy;

matching one or more units at the second level of the hierarchy to audio segments including matching the one or more units at the second level based on properties of a given unit at the second level and adjacent units at the first level where the levels are selected from the group comprising phrases, words, sub-words and phonetic segments; and synthesizing the input string including combining the audio segments associated with the first and second levels.

21. A method including receiving, by a processor, audio segments;

parsing the audio segments into units of a first level in a hierarchy of levels;

defining properties of and between the units at different levels, the properties between the units including articulation relationships;

storing the units and the properties associated with the units;

parsing the units into sub-units;

defining properties of and between the sub-units and between adjacent units and the sub-units; and storing the sub-units and the properties associated with the sub-units.

22. The method of claim 21 further comprising;

parsing a received input string to units;

determining properties of and between the units if any;

matching the units to the stored units using the properties;

parsing unmatched units to sub-units;

determining properties of and between the sub-units and the units if any;

matching one or more sub-units to the stored sub-units; and synthesizing the input string including combining the audio segments associated with the units and the sub-units.

23. The method of claim 21 where the units are phrase units and the sub-units are word units.

24. The method of claim 21 where the units are word units and the sub-units are phonetic segments.

25. The method of claim 21 further comprising:

defining properties between the units and the sub-units; and storing the properties associated with the units and the sub-units.

26. The method of claim 21 further comprising:

continuing to parse the sub-units to phonetic segments;

determining properties of and between phonetic segments if any; and storing the phonetic segments including the properties associated with the phonetic segments.

27. The method of claim 26 further comprising storing the phonetic segments without the properties associated with the phonetic segments.

28. The method of claim 27 further comprising parsing a received input string to units;

determining properties of and between the units if any;

matching the units to the stored units using the properties;

parsing unmatched units to sub-units;

determining properties of and between the sub-units and units if any;

matching one or more sub-units to stored sub-units;

parsing unmatched sub-units;

determining properties of and between the parsed sub-units, the sub-units and units if any;

matching the parsed sub-units to stored parsed units; and synthesizing the input string including combining the audio segments associated with the units, sub-units and parsed sub-units.

29. The method of claim 27 further comprising storing the parsed sub-units without the properties.

30. The method of claim 29 further comprising parsing a received input string to units;

determining properties between the units if any;

matching the units to the stored units using the properties;

parsing unmatched units to sub-units;

determining properties between the sub-units if any;

matching one or more sub-units to the stored sub-units;

parsing the unmatched sub-units;

determining properties between the parsed sub-units if any;

matching the parsed sub-units to the stored parsed units using the properties; and synthesizing the input string including combining the audio segments associated with the units, sub-units and parsed sub-units.

31. The method of claim 21 further comprising:

parsing the sub-units into parsed sub-units;

defining properties of and between the parsed sub-units, the units and sub-units; and storing the parsed sub-units and the properties associated with the parsed sub-units.

32. A method including:

receiving audio segments;

parsing the audio segments into units of a first level in a hierarchy of levels;

defining properties between the units;

storing the units and the properties;

parsing the units into units of a next level in the hierarchy of levels;

defining properties between the units in the next level and units in the first level;

storing the units of the next level and the properties between the units in the next level and the units in the first level;

continuing to parse units at a given level into units at a next level in the hierarchy until a final parsing is performed;

at each level, defining properties between units and adjacent units at a different level and storing the units and the properties between the units and the adjacent units at the different level; and at a final level in the hierarchy, storing units where the hierarchy of levels are selected from a group comprising phrases, words, sub-words and phonetic segments.

33. The method of claim 32 further comprising;

parsing a received input string to units;

determining properties for the units if any;

matching units having properties to stored units at a first level in the hierarchy;

parsing unmatched units in a given level of the hierarchy to units at a next level in the hierarchy;

determining properties for the parsed units if any;

matching one or more parsed units to stored units at a given level in the hierarchy; and synthesizing the input string including combining the audio segments associated with the units and parsed units.

* * * * *